United States Patent [19]

Vavala

[11] 4,441,883

[45] Apr. 10, 1984

[54] DYEING METHOD FOR CONTROL OF MULTICOLORED PATTERN NYLON CARPET

[75] Inventor: Louis M. Vavala, Colonial Heights, Va.

[73] Assignee: Allied Corporation, Morris Township, Morris County, N.J.

[21] Appl. No.: 301,343

[22] Filed: Sep. 11, 1981

[51] Int. Cl.[3] ..... D06P 5/15

[52] U.S. Cl. ..... 8/457; 8/463; 8/464; 8/620; 8/924; 8/929

[58] Field of Search ..... 8/457, 458, 463, 464, 8/585, 592, 620, 929

[56] References Cited

U.S. PATENT DOCUMENTS

| | | | |
|---|---|---|---|
| 2,248,128 | 7/1941 | Seymour et al. | 8/463 |
| 3,094,369 | 6/1963 | Bartl et al. | 8/453 |
| 3,104,150 | 9/1963 | Dadoly et al. | 8/530 |
| 3,445,177 | 5/1969 | McKesson | 8/457 |
| 3,972,677 | 8/1976 | Feess et al. | 8/464 |
| 3,999,940 | 12/1976 | Freeman | 8/449 |
| 4,059,653 | 11/1977 | Mathis et al. | 524/167 |
| 4,113,427 | 9/1978 | Fono et al. | 8/592 |
| 4,132,522 | 1/1979 | Fono et al. | 8/496 |
| 4,166,717 | 9/1979 | Fono et al. | 8/587 |
| 4,218,217 | 8/1980 | Redd | 8/478 |
| 4,227,881 | 10/1980 | Fono | 8/461 |
| 4,265,629 | 5/1981 | Ribka et al. | 8/449 |
| 4,314,811 | 2/1982 | Feess et al. | 8/457 |
| 4,314,812 | 2/1982 | Feess | 8/457 |

FOREIGN PATENT DOCUMENTS

| | | |
|---|---|---|
| 54-156885 | 12/1979 | Japan . |
| 1578039 | 10/1980 | United Kingdom . |

*Primary Examiner*—A. Lionel Clingman

*Attorney, Agent, or Firm*—Richard A. Anderson

[57] ABSTRACT

This invention is a method to dye nylon carpet in a pattern. Improvement comprises adding a reducing agent selected from a group consisting of zinc formaldehyde sulfoxylate, sodium formaldehyde sulfoxylate, thiourea dioxide and mixtures of the formaldehyde sulfoxylate salts with a dye selected from a group consisting of acid, direct, dispersed, fiber reactive and mixtures thereof; also adding an activator for the reducing agent and a stabilizer for the dye bath. Then the dyed carpet is steamed to activate the reducing agent. This makes a dyed pattern that is reproducible, controlled and has differential multicolorations. Each of the dyes is selected for its known characteristic behavior with the activator reducing agent, whether it is completely unaffected, partially affected or completely destroyed. Each dye is applied at a time during the dyeing so that its characteristic effect produces the desired multicoloration effect.

8 Claims, No Drawings

DYEING METHOD FOR CONTROL OF MULTICOLORED PATTERN NYLON CARPET

BACKGROUND OF THE INVENTION

This invention relates to a method to dye, by printing or the like, carpets to produce multicolor patterns.

In print dyeing of textiles to patterns with rotary screens, flat bed screens, Stalwart, controlled spray, TAK dyeing and the like, it is known to use reducing agents to resist dyeing or discharge dyed fabric. This resistor discharge printing is a two-step dye, dry, discharge process. Color discharges can be made by combining a dye stable to the reducing agent with the reducing agent.

For carpets, and nylon carpet in particular, differential coloration can be achieved in several ways, each resulting in variations. A common method is to apply dyestuffs on localized areas of the carpet by some form of printing then to flood the entire area with another dye. In this way, the localized color is covered over and the in-between areas are colored with the flood dye for a 100 percent coverage. The resulting color, when the flood color is superimposed on to the base color, is the composite of both colors and the outcome color is solid with only tonal variations of the two solid colors.

SUMMARY OF THE INVENTION

This invention is an improvement in a method of dyeing nylon carpet in a pattern. The improvement comprises a continuous, wet-on-wet process of adding a reducing agent selected from the group consisting of zinc formaldehyde sulfoxylate, sodium formaldehyde sulfoxylate mixtures thereof and thiourea dioxide with a dye selected from a group consisting of acid, direct, dispersed, fiber reactive and mixtures thereof. Also, an activator for the reducing agent and optionally a stabilizer for the dye bath is added. Then the dyed carpet is steamed, without drying, to activate the reducing agent to make a dyed pattern that is reproducible, and has controlled, differential multicolorations. Each of the dyes is selected for its known characteristic behavior with the activated reducing agent, whether it is completely unaffected, partially affected or completely destroyed. Each dye is applied at a time during the dyeing so that its characteristic effect produces the desired multicoloration effect. The preferred reducing agent is zinc formaldehyde sulfoxylate or thiourea dioxide. The activator for the reducing agent can be a salt, either acid or alkaline. The preferred activator is ammonium sulfate. The preferred stabilizers for the dye bath are the alkali metal salts of a sulfonated naphthalene condensate; more preferably, the sodium salt. The preferred amount of the reducing agent is about 5 to about 15 grams per liter of the liquid dye paste. The preferred amount of activator is about 2 to 10 grams per liter of the liquid dye paste. The preferred amount of the stabilizer is from about one-half to about 5 grams per liter of the liquid dye paste. The steaming should take place at about 100° C. for about 4 to 10 minutes. Reducing agent can be added with the print paste, with the flooding bath, with the TAK drops or in any two or all three of them. The carpet may be printed by the rotary screen method, the flat bed screen method, ColorFlo or Stalwart method and/or controlled spray method. Additional material may be added to any one of the dye formulations such as thickener, surfactant, sequesterant, or mixtures thereof. A tufted carpet dyed by this method will have each tuft with differential multicolorations along its length.

DETAILED DESCRIPTION OF THE INVENTION

This invention results in a multicolor appearance and sometimes an iridescence which is formed by the interplay of the dyestuffs according to the effect of the added chemicals to the print paste, the flooding dyebath, and/or TAK drops.

This invention calls for the regular printing procedure but with the addition of zinc formaldehyde sulfoxylate or other reducing agent and ammonium sulfate or other activator. By the irregular but consistent behavior of the reducing power of the zinc formaldehyde sulfoxylate activated by the acid which is liberated by the ammonium sulfate during steaming, a nonuniform coloration and interplay of color results producing an unique multicolor effect.

A necessary aspect of this invention is the proper selection of dyestuffs and these are categorized according to whether they are (a) completely unaffected, (b) partially affected or (c) completely destroyed by the action of the reducing agent.

A search of the dyestuffs on the market of the four major classes of dyes used for nylon—acid, direct, disperse and fiber reactive, has produced a sufficient number which are applicable concomitant with the normal fastness requirements.

This chemical mechanism of this invention can be utilized in several ways:

(a) By including the reducing agent in the paste by all the known methods of printing. This paste could include dischargeable, partially dischargeable and/or nondischargeable dye from any of the mentioned classes; then flood nondischargeable dyes.

(b) By including the reducing agent in the flooding bath with dischargeable, partially dischargeable and/or nondischargeable dyes over a print area which contains nondischargeable dyes.

(c) By including the reducing agent in both print paste and flooding bath using all the types of aforementioned dyes.

(d) By including the reducing agent in the TAK drops when TAK printing a dyed or printed carpet.

TAK printing is a method to mechanically position drops of dye on a carpet to be dyed as described in U.S. Pat. No. 4,127,014, column 1, hereby incorporated by reference in toto and more fully in a paper by Ferdinand Leifeld of Edward Kusters Machinefabrik, Krefeld, Germany, called *Multi-TAK—A Variable Pattern System for Carpet*, presented at the 1976 International Technical Conference of AATCC, October 13–15, Montreal, Quebec, Canada, and available from AATCC in printed form, P.O. Box 12215, Research Triangle Park, N.C. 27709. TAK is a trademark of E. Kuster of Germany.

EXAMPLES

| TYPICAL COMPOSITION USING SELECTED DYES WITH REDUCING AGENT (PARALITE) IN THE PRINT PASTE | |
|---|---|
| | 2 Grams/liter Celcagum D48D (gum thickener) a natural guar gum |
| Print: | 8 Grams/liter Resolin Yellow P8 GLN (disperse) |
| | 2 Grams/liter Lanasyn Red 2GL (acid) |
| | 15 Grams/liter Paralite (zinc formaldehyde sulfoxylate) |

-continued

| TYPICAL COMPOSITION USING SELECTED DYES WITH REDUCING AGENT (PARALITE) IN THE PRINT PASTE | |
|---|---|
| | 5 Grams/liter ammonium sulfate |
| | 6 Grams/liter Celcagum D48D (thickener) |
| Flood: | 2 Grams/liter Superlitefast Blue 2GLL (direct) |
| | 4 Grams/liter Erionyl Yellow 2RA (acid) |
| | 2 Grams/liter Milling Red SWB (acid) |
| | 1.5 Grams/liter Celcagum D48D (thickener) |
| | 2.0 Grams/liter Hostapur CX (surfactant) ethylene oxide condensate |
| | 0.2 Gram/liter Sequestrene ST (sequestering agent) ethylene diamine tetra acetic acid |
| | 4.0 Grams/liter ammonium sulfate (acid donor) |

In another example thiourea dioxide was added, as above, in place of Paralite (ZFS) and very similar results, as described herein, were obtained.

Following are procedures for including the reducing agent, thiourea dioxide or zinc formaldehyde sulfoxylate (ZFS) in the print paste, Kuster flood and TAK drops. Additionally, the thiourea dioxide or ZFS could be added in any two or all three of the applications of dye to carpet.

| PROCEDURE I - ZFS IN PRINT PASTE | |
|---|---|
| Wet Out: | 1-3 Grams/liter Celcagum D48D (gum thickener) |
| | 2-5 Grams/liter dioctyl sulfosuccinate wetting agent |
| Print: | Conventional method optional, including rotary screen, flat bed screen, controlled spray or Stalwart |
| 1 | Print Paste |
| | x Selected dyestuffs |
| | 5-10 Grams/liter ZFS |
| | 3-8 Grams/liter ammonium sulfate |
| | 1-3 Grams/liter Tamal (sodium salt of sulfonated naphthalene condensate) - optional |
| | Gum - proper viscosity for print method |
| 2 | Kuster Flood - in tandem - all over application |
| | x Grams per liter selected dyestuffs |
| | 1 Gram/liter Chemcogen 12DL (surfactant) |
| | 1-5 Grams/liter Celcagum D48D (thickener) |
| 3 | Steamer (conventional) |
| | 212° F. (100° C.) for 5 to 8 minutes |
| 4 | Washer (conventional) |
| | Wash boxes and sprays for thoroughly washing with cold water only |
| 5 | Dryer - continuous open width (conventional) |

| PROCEDURE II - ZFS IN KUSTER FLOOD | |
|---|---|
| Wet Out: | 1-3 Grams/liter Celcagum D48D (thickener) |
| | 2-5 Grams/liter wetting agent (Doss) |
| Print: | Method optional (see Procedure I) |
| 1 | Print Paste |
| | x Selected dyestuffs |
| | 3-8 Grams/liter acid or acid salt |
| | Gum - proper viscosity for print method |
| 2 | Kuster Flood |
| | x Selected dyestuffs |
| | 1-3 Grams/liter Tamal |
| | 3-8 Grams/liter ammonium sulfate |
| | 1-3 Grams/liter gum thickener |
| | 5-10 Grams/liter ZFS |
| 3 | Steamer (conventional) |
| | 212° F. (100° C.) for 5 to 8 minutes |
| 4 | Washer (conventional) |
| | Wash boxes and/or spray |
| 5 | Dryer - continuous open width (conventional) |

| PROCEDURE III - ZFS IN TAK DROPS | |
|---|---|
| Wet Out: | 1-3 Grams/liter Celcagum D48D (thickener) |
| | 2-5 Grams/liter wettinq agent (Doss) |
| Print: | Optional method (see Procedure I) |
| 1 | Print Paste |
| | x Grams per liter selected dyestuffs |
| | 3-8 Grams/liter acid or acid salt |
| | Gum to proper viscosity for print method |
| 2 | Kuster Flood |
| | x Selected dyestuffs |
| | 1 Gram/liter Chemcogen 12DL (surfactant) |
| | 1-5 Grams/liter Celcagum D48D (thickener) |
| 3 | TAK Drops |
| | x Selected dyestuffs |
| | 5-10 Grams/liter ZFS |
| | 1-3 Grams/liter acid or acid salt |
| | 1-3 Grams/liter Hostapur CX (surfactant) |
| | Gum Thickener |
| 4 | Steam (conventional) |
| | 212° F. (100° C.) for 5 to 8 minutes |
| 5 | Washer (conventional) |
| 6 | Dryer - continuous open width (conventional) |

DISCUSSION

The above procedures are duplicated adding thiourea dioxide in place of ZFS to get the same results described herein.

The dyeing process of this invention is distinguished from prior art methods. This process is the first to achieve a wet-on-wet, continuous process to create variations of color in *depth* in a carpet. That is, this use of the specific activated reducing agents produces variations of color along the length of each tuft of yarn in the carpet. The reducing agent, such as ZFS, affects dyes in the dye base (bath, paste or the like) differentially, but reproducibly and predictably from the dyes selected, causing multicolorations, color separation and even sometimes colors not introduced to the dye base by the chemical interaction during steaming which activates the reducing agent. Previous methods were able to produce only two colors, not the multicolors of this invention, because the previous discharge method, dye, dry, discharge printing can only discharge to white on a color background or color discharge on another color background resulting in two colors with tonal variations.

I claim:

1. In the method of dyeing nylon carpet in a pattern, the improvement comprising a continuous, wet-on-wet process of adding a reducing agent selected from the group consisting of zinc formaldehyde sulfoxylate, sodium formaldehyde sulfoxylate, mixtures thereof and thiourea dioxide with a mixture of two or more dyes selected from the group consisting of acid, direct, disperse, fiber reactive and mixtures thereof; and an activator for the reducing agent wherein the activator is a salt, either acid or alkaline, then dyeing and without drying, steaming the dyed carpet to make dyed patterns that are reproducible, controlled differential multicolorations, each of said dyes being selected for its known characteristic behavior with the activated reducing agent, whether completely unaffected, partially affected or completely destroyed, and each dye being applied at a time during the dyeing so that its characteristic effect produces the desired multicoloration effect wherein each tuft has differential multicoloration along its length.

2. The method of claim 1 wherein the reducing agent is zinc formaldehyde sulfoxylate.

3. The method of claim 1 wherein the salt is ammonium sulfate.

4. The method of claims 1 or 2 wherein a stabilizer which is the alkali metal salt of a sulfonated naphthalene condensate is added.

5. The method of claim 4 wherein about five to fifteen grams per liter of liquid dye paste of reducing agent is added to the liquid dye paste, about two to ten grams per liter of liquid dye paste of activator is added to the liquid dye paste, and about one-half to five grams per liter of liquid dye paste of stabilizer is added to the liquid dye paste.

6. The method of claim 1 wherein the steaming takes place at about 100° C. for about four to about ten minutes.

7. The method of claim 1 wherein additional material selected from the group consisting of stabilizer, thickener, surfactant, sequesterant, and mixtures thereof is added.

8. A tufted carpet dyed by the method of claim 1 wherein each tuft has differential multicoloration along its length.

* * * * *